US005582524A

United States Patent [19]

Sanner et al.

[11] Patent Number: 5,582,524

[45] Date of Patent: Dec. 10, 1996

[54] CORD LOCK

[75] Inventors: Dennis Sanner, Indianapolis; Douglas Wright, Clermont, both of Indiana

[73] Assignee: Woods Industries, Inc., Carmel, Indiana

[21] Appl. No.: 490,418

[22] Filed: Jun. 14, 1995

[51] Int. Cl.[6] ..... H01R 13/62; H01R 43/00

[52] U.S. Cl. ..... 439/369; 29/869

[58] Field of Search ..... 439/367, 368, 439/369, 370, 371, 449, 451, 453; 29/869, 870, 871

[56] References Cited

U.S. PATENT DOCUMENTS

| | | | |
|---|---|---|---|
| 3,014,194 | 12/1961 | Berglund . | |
| 3,030,601 | 4/1962 | Krebs . | |
| 3,383,639 | 5/1968 | Anderson et al. . | |
| 3,475,716 | 10/1969 | Laig . | |
| 3,520,988 | 7/1970 | Ballock . | |
| 3,609,638 | 9/1971 | Darrey . | |
| 3,781,761 | 12/1973 | Harwood . | |
| 3,922,055 | 11/1975 | McGregor . | |
| 3,999,828 | 12/1976 | Howell . | |
| 4,183,603 | 1/1980 | Donarummo . | |
| 4,221,449 | 9/1980 | Shugart . | |
| 4,504,106 | 3/1985 | Fechter . | |
| 4,610,494 | 9/1986 | Schauber | 439/453 |
| 4,664,463 | 5/1987 | Camro . | |
| 5,167,524 | 12/1992 | Falcon et al. . | |
| 5,211,573 | 5/1993 | Cross . | |
| 5,255,866 | 10/1993 | Campolo . | |
| 5,336,106 | 8/1994 | Osten | 439/369 |
| 5,423,693 | 6/1995 | Light | 439/369 |
| 5,514,004 | 5/1996 | Swanson | 439/369 |

FOREIGN PATENT DOCUMENTS 2605810A 4/1986 France .

*Primary Examiner*—Neil Abrams
*Assistant Examiner*—Yong Kim
*Attorney, Agent, or Firm*—McAndrews, Held & Malloy, Ltd.

[57] ABSTRACT

A cord securement device for maintaining two interconnected electrical plugs in plugged together electrical connection. The device includes first and second eyelets secured to a base member. Each eyelet defines an opening sized to receive a looped portion of each electrical cord extending from the plugged together ends. The looped portion of each cord is urged through one eyelet to engage a hook member secured to the base member. The hook members transfer the strain of connection of the electrical cords from the plugs to the cord securement device. A method is also disclosed which maintains the electrical plugs in plugged together relationship by transferring the strain of connection from the plugs of the electrical cords to the device.

14 Claims, 2 Drawing Sheets

FIG. 3
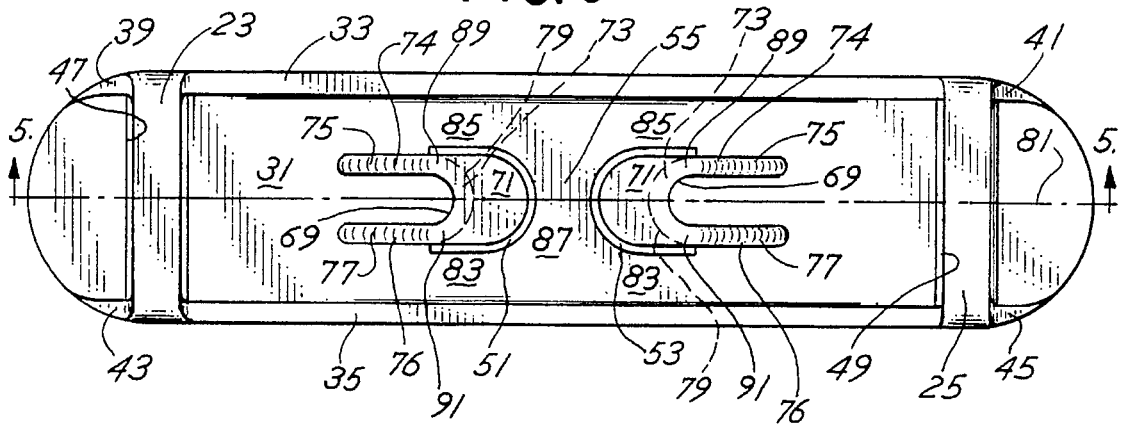
FIG. 4
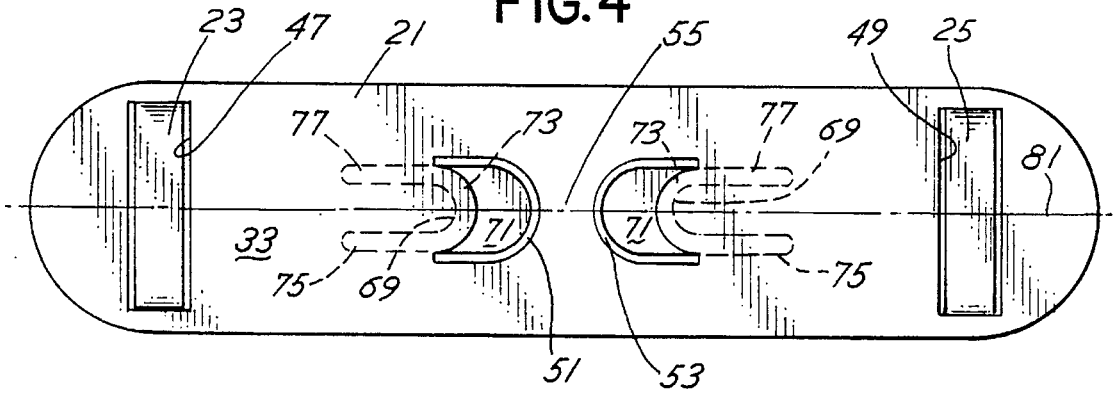
FIG. 5
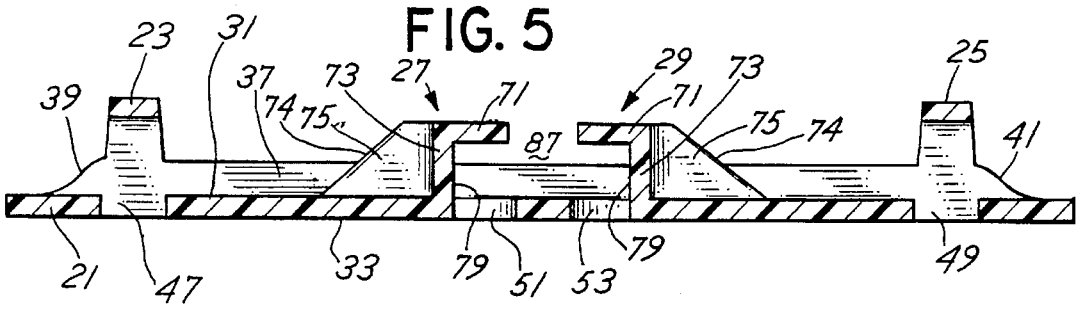
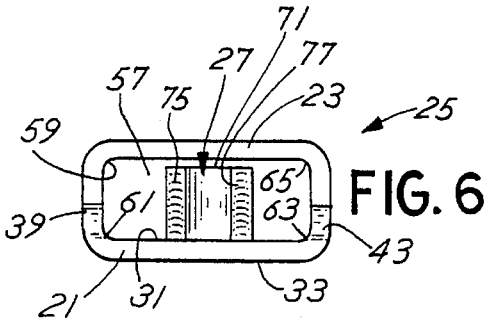
FIG. 6

CORD LOCK

FIELD OF THE INVENTION

This invention relates to a device for preventing separation of two connected electrical cords and, more specifically, to an electrical cord securement device which holds two interconnecting electrical plugs together without imposing unnecessary forces on the plugs themselves.

BACKGROUND OF THE INVENTION

Power tools and other portable electrical equipment are generally equipped with a relatively short electrical power cord having a male plug at the end thereof. However, a longer power cord is often required to provide power to the tools in an area remotely located from an electrical outlet. As a result, power tools are frequently connected to remote outlets via extension cords. An extension cord is an electric cord fitted with a male plug at one end and a female receptacle at the other end. The female receptacle end of the extension cord is mated with the male plug of the power tool cord. The male plug of the extension cord is inserted into a conventional outlet, providing an electrical connection between the outlet and the power tool. Additionally, numerous extension cords may be connected together, extending the distance of the electrical connection between power tools and remote outlets.

Electrical cords maintain a plugged together relationship between prongs of the male plug and corresponding receptacles of the female plug through friction. The friction between the plugs is adequate to maintain the electrical cords in a plugged together relationship when the cords are stationary. However, the friction between plugs may be insufficient to hold the electrical cords together when the cords are moved around, such as at a construction site. In the latter situation, the insufficient friction between the plugs causes them to accidentally separate, interrupting the flow of electricity to the power tool. The interruption of the flow of electricity to the tool can be annoying and time consuming, and sometimes possibly dangerous in certain situations.

Numerous inventions have been devised to solve the problem of accidental separation of the male and female plugs of electrical cords. One solution has been the use of a device that clamps the male and female plugs together. A device that clamps plugs together is disclosed in U.S. Pat. No. 4,183,603, issued to Carmo. The Carmo patent shows various mechanisms for holding the connection between the plugs, including, for example, a thumbwheel which is rotated to firmly press the male plug and the female plug together. Another device that holds the connection between plugs is disclosed in U.S. Pat. No. 3,383,639, issued to Anderson et al. The Anderson patent shows an extension cord coupling clamp conforming around the ends of the male and female plugs to keep them connected. These devices, however, place an undue amount of strain on the connection between the plugs, and, therefore, may damage the plugs or the electrical cords.

Accordingly, some devices have been constructed to relieve, at least partially, the strain on the connection by clamping the electrical cords without imposing unnecessary forces on the plugs themselves. For example, a strain relief device having a pair of clamps connected by a threaded rod extension is disclosed in U.S. Pat. No. 3,609,638, issued to Darrey. Each clamp securely grips the electrical cord with the connected male and female ends disposed therebetween. Such devices which employ a clamp or similar apparatus may damage the electrical integrity of the conductors, the insulation, or the cover of the extension cord.

Other strain relief devices have been constructed without the use of potentially damaging clamps. In U.S. Pat. No. 5,255,866, issued to Campolo, a stain relief device is disclosed consisting of a rigid hollow cylinder with two rigid flanges extending at opposite ends of the cylinder. The joined plugs of two electrical cords are positioned inside the cylinder. Each respective cord is bent back through slots in the flanges and wound around the cylinder between the flanges, thereby transmitting tension between the electrical cords to the cylinder and flanges. However, these devices waste a considerable amount of the extension cord due to the necessity of winding the cord around the device to transfer the strain from the cord to the device. In addition, devices such as the one disclosed by Campolo prevents visual inspection of the connection between the two cords.

Therefore, it is an object of this invention to provide a device with a practical construction for maintaining the connection between male and female plugs while not imposing undue strain on the plugs.

Another object of this invention is to provide a device for holding the connection between male and female plugs and which can be manufactured easily and at a low cost from commercially available materials.

A further object of this invention is to provide a device for maintaining the connection between male and female plugs and which prevents the cords from becoming worn or damaged.

Yet another object of this invention is to provide a device for holding the connection between male and female plugs and which the user can easily inspect the integrity of the connection between the male and female plugs.

These and other objects and advantages of the present invention will become apparent from the following description.

SUMMARY OF THE INVENTION

A cord securement device is set forth that overcomes the foregoing problems. The device is comprised of a base member having a pair of eyelets, each eyelet defining an opening of a size for allowing the passage of a looped electrical cord. A pair of hook members are secured to the base member and spaced from the eyelets. Each hook member is shaped for receiving the looped portion of the electrical cord.

The cord securement device maintains the electrical cords in a plugged together relationship through strain relief from the cords to the device without physically clamping or crimping the cords. The device also allows the user to visually examine the integrity of the connection between the plugs.

Other objects and advantages of the invention will become apparent upon reading the following detailed description and appended claims, and upon reference to the accompanying drawings.

BRIEF DESCRIPTION OF THE DRAWINGS

FIG. 3 is a top view of the cord securement device of FIG. 3;

FIG. 4 is a bottom view of the cord securement device of FIG. 3;

FIG. 5 is a cross-sectional side view of the cord securement device of FIG. 3; and FIG. 6 is a end view of the cord securement device of FIG. 3, with each end view of the cord securement device being identical.

DETAILED DESCRIPTION OF THE INVENTION

Figure 1:
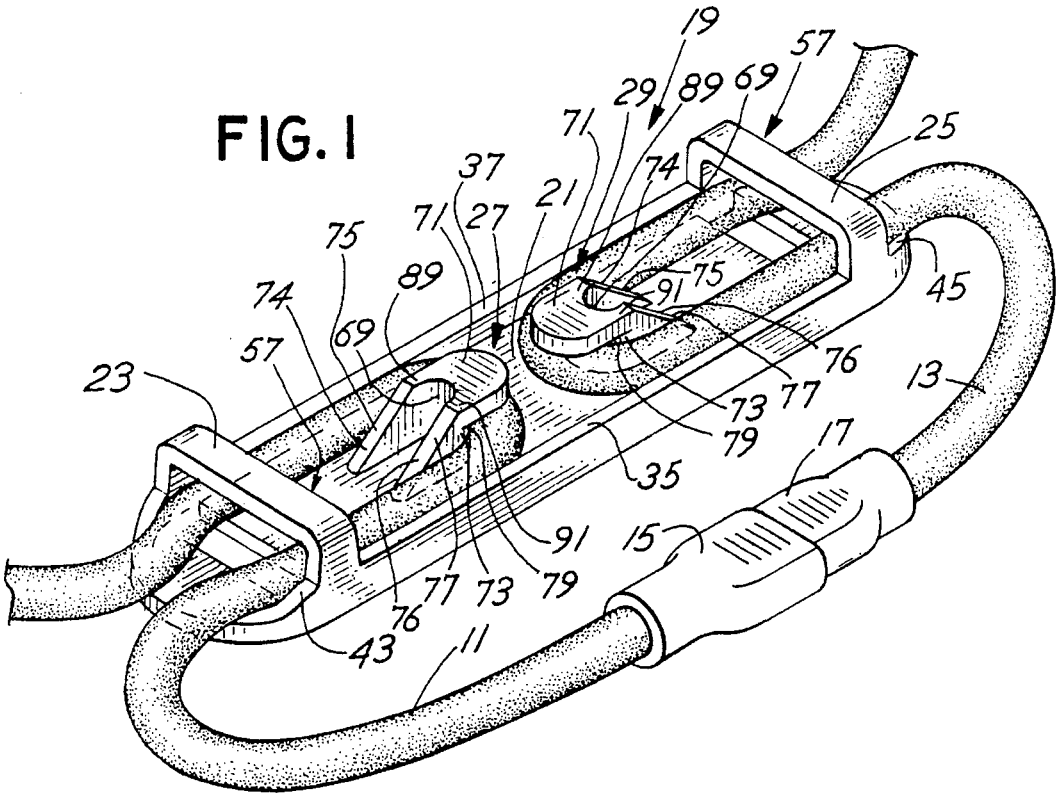
FIG. 1 is a perspective view of an embodiment of a cord securement device of the present invention, installed with a connected male and female plugs, and associated cords.
Figure 2:
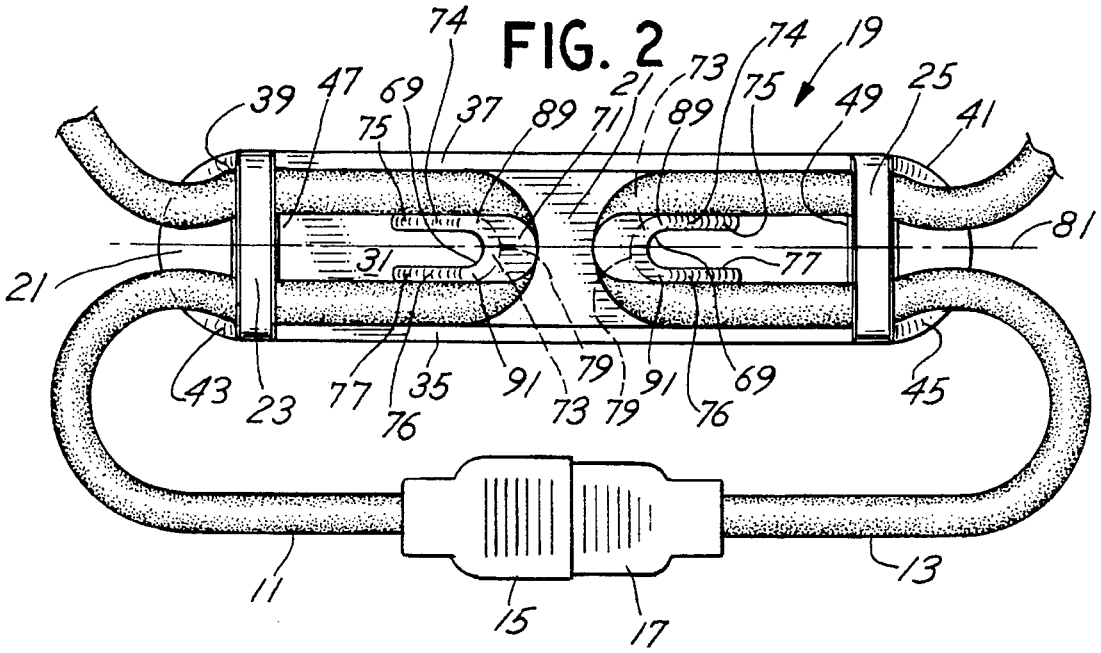
FIG. 2 is a top plan view of the embodiment of the cord securement device installed on the connected male and female plugs and associated cords of FIG. 1.

Referring to FIGS. 1 and 2, a pair of electrical cords 11, 13 are respectively connected to a male plug 15 and a female plug 17. Typically, male plug 15 includes protruding conductor blades (not shown) which are inserted into receptacles (not shown) embedded within the female plug 17. The blades are urged into frictional engaging contact with the receptacles in order to interconnect the two plugs 15, 17, as shown in FIG. 1.

A cord securement device 19 is used to maintain the connection between plugs 15, 17. Electrical cords 11, 13 are positioned onto securement device 19 so as to relieve the plugs from strain sometimes attendant thereon from forces developed on cords 11, 13. Cord securement device 19 is comprised of a base member 21, a pair of eyelet members 23, 25 disposed at opposite ends of the base member 21 and a pair of hook members 27, 29 disposed centrally on base member 21 and facing opposite each other.

Base member 21, as best illustrated in FIGS. 3–5, is elongated in shape, generally rectangular and with semicircularly shaped ends. Base member 21 includes a flat top surface 31 (FIG. 5) and a flat bottom surface 33 (FIG. 5). Base member 21 is of uniform thickness, as shown in FIG. 5. A pair of lateral side walls 35, 37 stand upward from the base member 21. Side walls 35, 37 slope gradually downward toward base member 21 at areas 39, 41 and 43, 45 (FIGS. 2 and 3). Each side wall 35, 37 serves as a horizontal member for lateral support of electrical cords 11, 13 as the cord rests on top surface 31 of the base member.

As best illustrated in FIGS. 4 and 5, the bottom surface 33 of the base member 21 includes a pair of rectangular slots 47, 49 and a pair of U-shaped apertures 51, 53. The rectangular slots 47, 49 are disposed beneath eyelet members 23, 25 and extend between side walls 35, 37 of the base member 21. The u-shaped apertures 51, 53 are disposed as mirror opposites of each other about a center point 55 of the base member 20.

Referring to FIG. 6, each eyelet member 23, 25 is U-shaped in cross section and is formed integral with side walls 35, 37. A rectangular opening 57 with rounded corners 59, 61, 63, 65 is formed from base member 21, side walls 35, 37 and u-shaped eyelet member 23 or 25. Opening 57 serves as an eyelet. The two eyelets 57 span the width of the base member 21 and extend above the top surface 31 of the base member 21. Each eyelet 57 is of sufficient height and width to allow a looped portion of the electrical cord (FIG. 2) to pass through each eyelet 57.

Referring again to FIG. 1, each hook member 27, 29 is comprised of a curved wall 69 and a planar brim 71. As shown in FIG. 2, curved wall 69 includes a cylindrical section 73 and leg sections 75, 77. Cylindrical section 73 includes an outer cylindrical surface 79 against which the inside surface of the loop of the electrical cord (FIGS. 1 and 2) rests. Each hook member 27, 29 is disposed on flat top surface 31 of the base member 21 and arrange opposite the other about the center point 55 of the base member 21. Each leg section 75, 77 is disposed parallel to side walls 35, 37, as well as to the elongate axis 81 of the base member 21, and is spaced from its closer side wall 35, 37 to provide a slot area or groove 83, 85 (FIG. 3) for receiving the loop. Each curved wall 69 is spaced apart from the opposite curved wall 6 sufficient distance to provide a slot area 87 (FIG. 3) sized to allow a portion of each loop to fit between the hook members 27, 29.

Each planar brim 71 is generally u-shaped and includes legs 89, 91. Each leg 89, 91 is disposed parallel to the elongated axis 81 of the base member 21 and adjoins to the cylindrical section 73 of the curved wall 69. Each brim 71 extends horizontally from the curved wall 69 toward the center point 55 of the base member 21. The brim 71 is of sufficient height from the top surface 31 to allow an electrical cord to be disposed beneath the brim. The brim helps maintain contact between the cylindrical surface 79 and the electrical cord, thereby preventing the accidental disengagement of the electrical cords 11, 13 from hook members 27, 29.

As shown in FIGS. 1 and 2, a pair of electrical cords 11, 13 are connected by the mating of male plug 15 with female plug 17. The connected plugs 15, 17 are then positioned parallel to the elongate axis 81 of the base member 21 and spaced to the side of the base member 21. The connected plugs 15, 17 may be disposed adjacent to the base member 21 with each plug 15, 17 equidistant from the center point 55.

A looped portion of electrical cord 11 is urged through eyelet 57 and onto hook member 27. Likewise, a looped portion of electrical cord 13 is urged through eyelet 57 and onto hook member 29. The strain associated with the connection of plugs 15, 17 is transferred to the cord securement device 19, thereby maintaining cords 11, 13 in a plugged together relationship. In addition, the user can visually inspect the integrity of the connection between the plugs 15, 17 disposed adjacent to the base member 21 of the cord securement device 19.

In addition, the cord securement device 19 can be utilized as a cord storage device. The plugs 15, 17 of cords 11, 13 are unconnected, but cords 11, 13 are engaged with the cord securement device 19 as previously described. The remaining electrical cord (not shown) is wound in a circular pattern around the device 19. A section of the wound cord is disposed between the cord securement device 19 and unconnected plugs 15, 17. The plugs 15, 17 are then urged together in frictional engagement thereby enclosing the circular-wounded section of electrical cord.

The cord securement device 19 is preferably molded as a singular piece from a plastic material. However, it should be noted that materials other than plastic may be used.

Thus, cord securement device 19 is a practical, one-piece construction that will hold a connection between male and female plugs 15, 17 without imposing undue strain on the plugs. In addition, the device 19 may be easily manufactured at a low cost from commercially available materials. Moreover, cord securement device 19 is relatively resistant to damage and also prevents electrical cords 11, 13 from becoming worn or damaged. In addition, the device 19 allows the connection of plugs 15, 17 to be visually inspected.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A cord securement device for maintaining two plugged together electrical cords in plugged together electrical connection, the securement device comprising:

an elongated base member having a first end and a second end;

a first eyelet secured to said base member closer to said first end than said second end, said first eyelet defining an opening of a size for receiving a first loop of an electrical cord;

a second eyelet secured to said base member closer to said second end than said first end, said second eyelet defining an opening of a size for receiving a second loop of the electrical cord;

a first hook member secured to said base member and spaced from said first eyelet, said first hook member being shaped for receiving said first loop; and a second hook member secured to said base member and spaced from said second eyelet, said second hook member being shaped for receiving said second loop.

2. A cord securement device as claimed in claim 1 wherein said base member includes a flat top surface upon which the first and second loops rest, and wherein each of said openings of said eyelets having a first section aligned with said top surface.

3. A cord securement device as claimed in claim 2 and further comprising a pair of wall members disposed along the sides of said base member and upstanding from said top surface so as to laterally engage said first and second loops.

4. A cord securement device as claimed in claim 2 wherein said eyelets comprise a u-shaped support defining a second section of said opening.

5. A cord securement device as claimed in claim 3 wherein said first and second eyelets adjoin said pair of wall members.

6. A cord securement device as claimed in claim 1 wherein said base member has a center point and wherein said hook members are equally spaced about said center point.

7. A cord securement device as claimed in claim 1 wherein each of said hook members includes a curved surface for engaging an inside surface of a loop of the electrical cords.

8. A cord securement device as claimed in claim 7 wherein each of said hook members further comprise a brim laterally extending from said curved surface, said brim assisting in maintaining the electrical cord against said curved surface of its respective said hook member.

9. A cord securement device as claimed in claim 1 wherein said device is molded as one piece from plastic.

10. A cord securement device as claimed in claim 9 wherein said base member has an slot formed below each eyelet, each said slot extending between the side walls of said base member.

11. A cord securement device as claimed in claim 10 wherein said base member has an aperture formed below each hook member, each said aperture equally spaced about said center point.

12. A cord securement device as claimed in claim 2 wherein said first and second ends are semicircular, circular, each said end adjoins to each first section of the opening.

13. A cord securement device as claimed in claim 1 wherein the plug of each electrical cord is disposed adjacent to the base member, each said plug being relatively equidistant from said center point.

14. A method to maintain locked engagement between a first electrical cord having a male plug and a second electrical cord having a female plug using a pair of eyelets and a pair of hooks, the method comprising:

a) connecting the male plug of the first electrical cord to the female plug of the second electrical cord;

b) urging a looped portion of the first electrical cord through a first eyelet;

c) engaging the looped portion of the first electrical cord onto a first hook member;

d) fixing the first eyelet relative to the first hook member;

e) urging a looped portion of said second electrical cord through a second eyelet;

f) engaging the looped portion of the second electrical cord onto a second hook member; and g) fixing the second eyelet relative to the second hook member.

* * * * *